US012256826B2

(12) United States Patent
Chang

(10) Patent No.: US 12,256,826 B2
(45) Date of Patent: Mar. 25, 2025

(54) OBJECT CARRIER

(71) Applicant: Teng-Yao Chang, Taichung (TW)

(72) Inventor: Teng-Yao Chang, Taichung (TW)

( * ) Notice: Subject to any disclaimer, the term of this patent is extended or adjusted under 35 U.S.C. 154(b) by 202 days.

(21) Appl. No.: 18/095,514

(22) Filed: Jan. 10, 2023

(65) Prior Publication Data

US 2024/0225246 A1 Jul. 11, 2024

(51) Int. Cl.

| | |
|---|---|
| ***A45F 3/14*** | (2006.01) |
| ***A45C 13/30*** | (2006.01) |
| ***A45F 5/02*** | (2006.01) |

(52) U.S. Cl.

CPC ..... *A45F 3/14* (2013.01); *A45C 13/30* (2013.01); *A45F 5/021* (2013.01); *A45F 2003/142* (2013.01)

(58) Field of Classification Search

CPC ..... A45F 5/021; A45F 5/02

See application file for complete search history.

(56) References Cited

U.S. PATENT DOCUMENTS

| | | | | |
|---|---|---|---|---|
| 6,161,742 | A * | 12/2000 | Kiser | A45F 5/021 224/904 |
| 7,111,731 | B2 * | 9/2006 | Pratt | A45C 5/06 150/900 |
| 9,144,294 | B2 * | 9/2015 | Gregory | A45F 5/02 |
| 2003/0218038 | A1 * | 11/2003 | Chang | A45F 5/02 224/675 |

FOREIGN PATENT DOCUMENTS

| | | | | |
|---|---|---|---|---|
| GB | 2513321 | A * | 10/2014 | A45F 5/02 |

* cited by examiner

*Primary Examiner* — Scott T McNurlen

(74) *Attorney, Agent, or Firm* — Apex Juris, pllc; Hilde Coeckx

(57) ABSTRACT

An object carrier includes a sheet body, at least two first straps, a strap body, and at least two second straps. The sheet body has a receiving space therein and an upper opening and a lower opening. The sheet body has a first surface and a second surface opposite to the first surface. The second surface has a connecting portion for connecting to an object. Each of the first straps and the first surface are connected and jointly form at least one first through hole. The strap body has a free end and a connecting end connected to the first surface and located at the upper opening. The strap body has a third surface and a fourth surface opposite to the third surface. The first surface extends to form the third surface. Each of the second straps and the fourth surface are connected and jointly form a second through hole.

18 Claims, 15 Drawing Sheets

OBJECT CARRIER

BACKGROUND OF THE INVENTION

Technical Field

The present invention relates generally to an object carrier, and more particularly to an object carrier, which could adjust a center of gravity while wearing the object carrier.

Description of Related Art

A conventional object carrier is adapted to carry an object and could be worn through a waistband, a strap, or a fastener for example, allowing a user to carry the object conveniently and to free the user's hands during moving or working, thereby enhancing the moving efficiency or working efficiency.

However, as the body shape of different users is different and the object carried by the conventional object carrier has different weights or lengths, the conventional object carrier could not provide different centers of gravity depending on the body shape of the user or the object carried, which causes inconvenience or discomfort while wearing. Therefore, how to provide an object carrier that could adjust a center of gravity while wearing is a problem needed to be solved in the industry.

BRIEF SUMMARY OF THE INVENTION

In view of the above, the primary objective of the present invention is to provide an object carrier, which could provide different centers of gravity depending on a body shape of a user or an object carried.

The present invention provides an object carrier including a sheet body, at least two first straps, a strap body, and two second straps. The sheet body has a receiving space therein and has an upper opening and a lower opening respectively located on two opposite sides of the receiving space for communicating the receiving space with an external space. The sheet body has a first surface and a second surface opposite to the first surface. The second surface has a connecting portion adapted to be connected to an object. Each of the at least two first straps and the first surface are connected to jointly form at least one first through hole. The strap body has a connecting end and a free end, wherein the connecting end is connected to the first surface of the sheet body and is located at the upper opening. The strap body has a third surface and a fourth surface opposite to the third surface. The third surface is formed by extending from the first surface. Each of the at least two second straps and the fourth surface are connected to jointly form a second through hole. The strap body bends relative to the sheet body at the connecting end, and the free end is adapted to enter the receiving space through the upper opening or the lower opening.

With the aforementioned design, the first through holes or the second through holes of the object carrier could be provided for the connecting member, such as the waistband, the strap, or the fastener, to pass through, and the object carrier could be attached to the user or the accessory, such as the bag, via the connecting member. As the first through holes and the second through holes are disposed on different positions, the user could select from the first through holes or the second through holes to adjust the center of gravity upon the required demand. Additionally, when the strap body bends relative to the sheet body at the connecting end, and the free end enters the receiving space through the lower opening to be received in the receiving space, the strap body and the sheet body could jointly surround to form the annular hole. In this way, the annular hole could be passed through by the connecting member, such as the waistband, the strap, or the fastener. Moreover, the upper opening of the sheet body could be passed through by the connecting member, such as the waistband, the strap, or the fastener as well. In summary, the object carrier of the present invention could provide multiple wearing ways for the user to select, thereby enhancing comfortability and convenience.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1A:
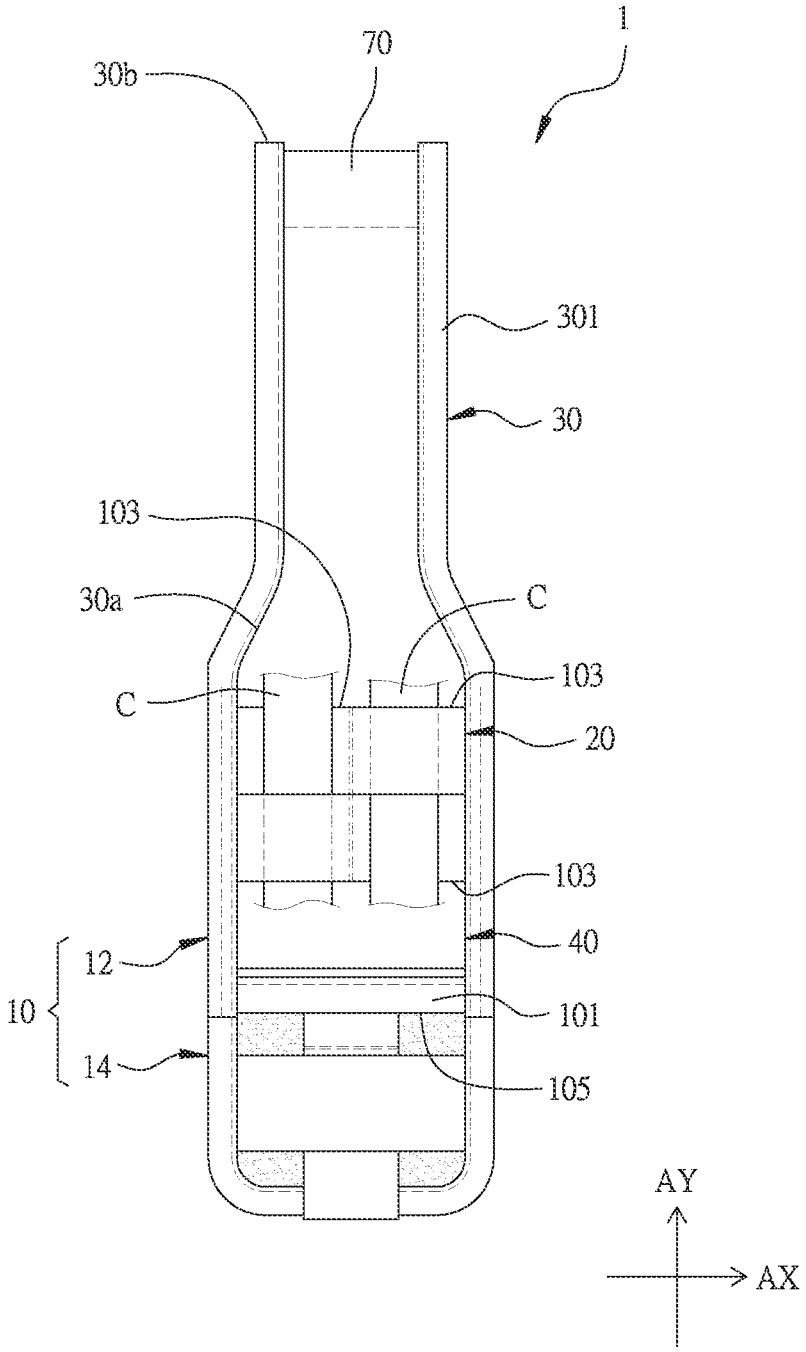
FIG. 1*a* is a front view of the object carrier according to an embodiment of the present invention.
Figure 2:
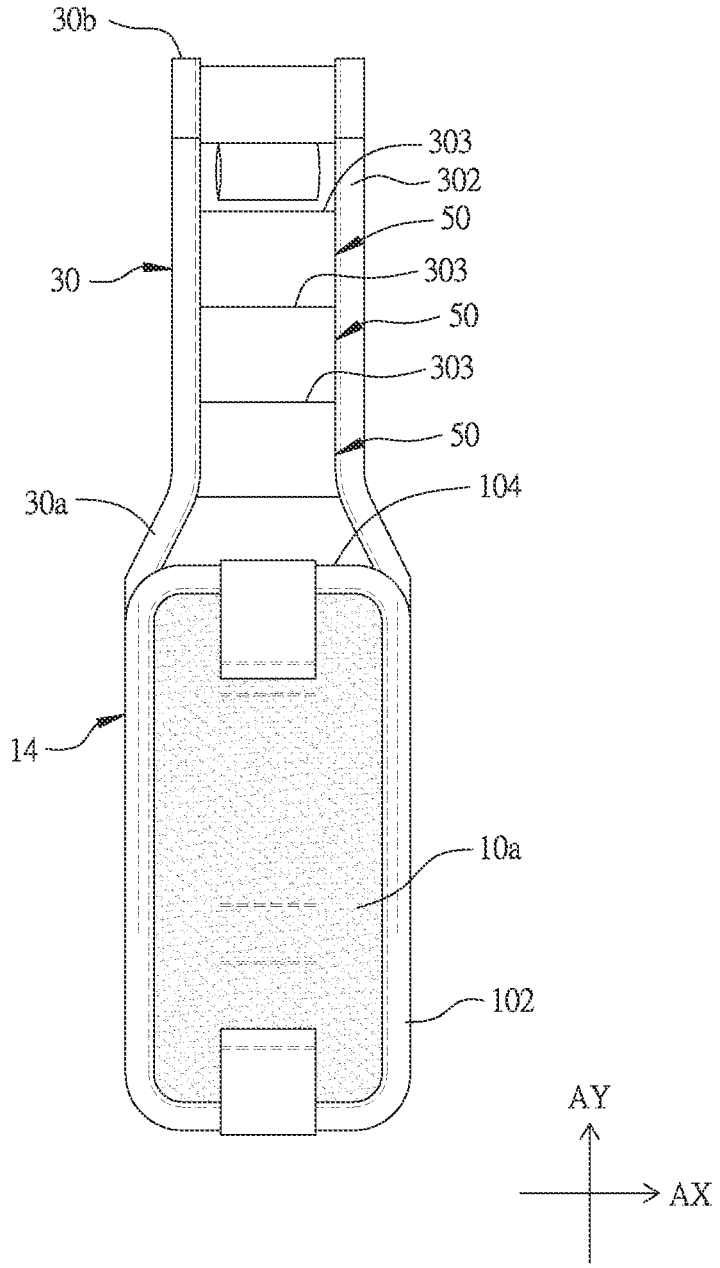
FIG. 2 is a rear view of the object carrier according to the embodiment of the present invention.

An object carrier 1 according to an embodiment of the present invention is illustrated in FIG. 1*a* and FIG. 2 and includes a sheet body 10, two first straps 20, a strap body 30, a positioning strap 40, and three second straps 50.

As shown in FIG. 1*a* and FIG. 2, the sheet body 10 has a first surface 101 and a second surface 102 opposite to the first surface 101, wherein the second surface 102 has a connecting portion 10*a* adapted to be connected to an object. In the current embodiment, the connecting portion 10*a* includes, but not limited to, a Velcro for being connected to the object. In other embodiments, the connecting portion 10*a* could include a magnet, a fastener, a clasp, or any unit that could be connected to the object; additionally, the connecting portion 10*a* could be connected to the object in a undetachable way such as sewing or gluing.

As shown in FIG. 1*a*, the first straps 20 are respectively connected to the first surface 101 and are arranged parallelly to be adjacent to each other in a vertical direction AY. Each of the first straps 20 and the first surface 101 jointly form two first through holes 103 arranged adjacently in a horizontal direction AX perpendicular to the vertical direction AY. In the current embodiment, two ends of each of the first straps 20 are respectively fixed on the first surface 101 to make each of the first straps 20 and the first surface 101 jointly form a through hole, and a middle of each of the first straps 20 is fixed on the first surface 101 via sewing, thereby the through hole formed by each of the first straps 20 and the first surface 101 is divided into the two first through holes 103 arranged adjacently in the horizontal direction AX, and the two first through holes 103 of the two first straps 20 arranged adjacently in the vertical direction AY could communicate with each other. In this way, a connecting member C, such as a waistband, a strap, or a fastener, could pass through one of the first through holes 103 of the upper one of the first straps 20 in the vertical direction AY or one of the first through holes 103 of the lower one of the first straps 20 in the vertical direction AY for adjusting a center of gravity upon the required demand; additionally, the connecting member C could pass through one of the first through holes 103 of each of the first straps 20 at the same time.

In the current embodiment, the number of the first strap 20 is two for illustration. In practice, the number of the first strap 20 could be three or more. For example, three or more first straps 20 could be arranged in a way parallel to one another and located adjacently in the vertical direction AY. Moreover, in the current embodiment, each of the first straps 20 and the first surface 101 jointly form the two first through holes 103 arranged adjacently in the horizontal direction AX. In other embodiments, each of the first straps 20 and the first surface 101 could jointly form one first through hole or more than two first through holes 103 arranged adjacently in the horizontal direction AX.

Figure 8:
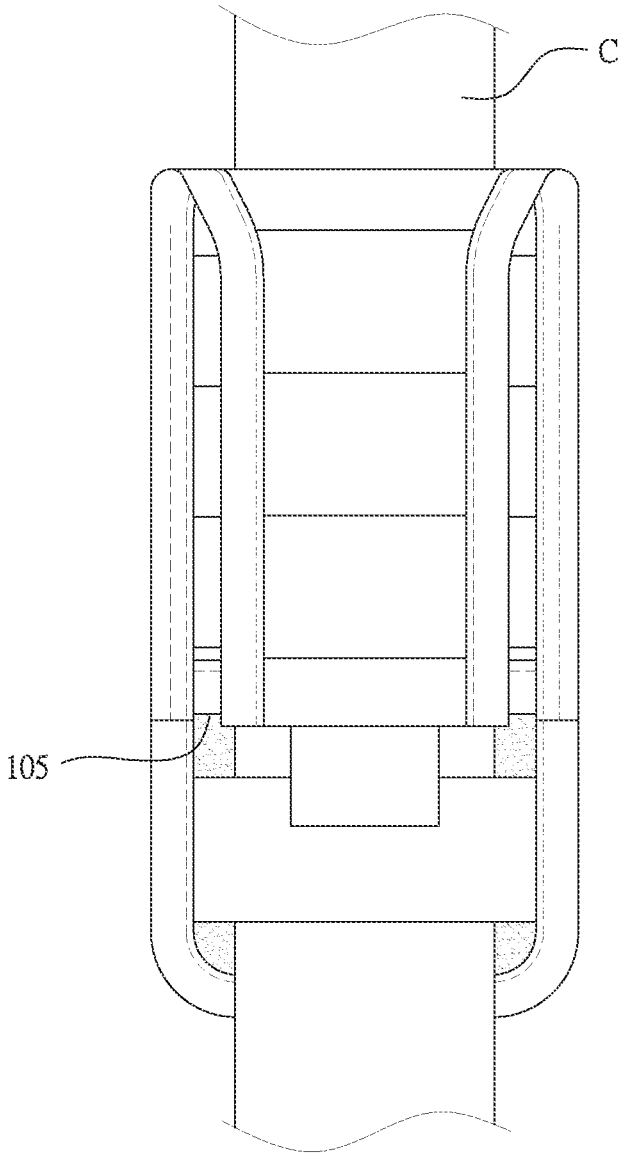
FIG. 8 is a schematic view, showing that the connecting member passes from the upper opening of the sheet body and through the lower opening according to the embodiment of the present invention.

The sheet body 10 has a receiving space therein and has an upper opening 104 (as shown in FIG. 2) and a lower opening 105 (as shown in FIG. 1*a*) respectively located on two opposite sides of the receiving space for communicating the receiving space with an external space. The sheet body 10 includes a first sheet body 12 and a second sheet body 14 that is stacked on each other. The first sheet body 12 has the first surface 101, and the second sheet body 14 has the second surface 102. The receiving space is located between the first sheet body 12 and the second sheet body 14 and is surrounded by the first sheet body 12 and the second sheet body 14. In this way, referring to FIG. 8, the connecting member C, such as the waistband, the strap, or the fastener, could enter the receiving space through the top opening 104 and exit the receiving space through the lower opening.

Figure 3:
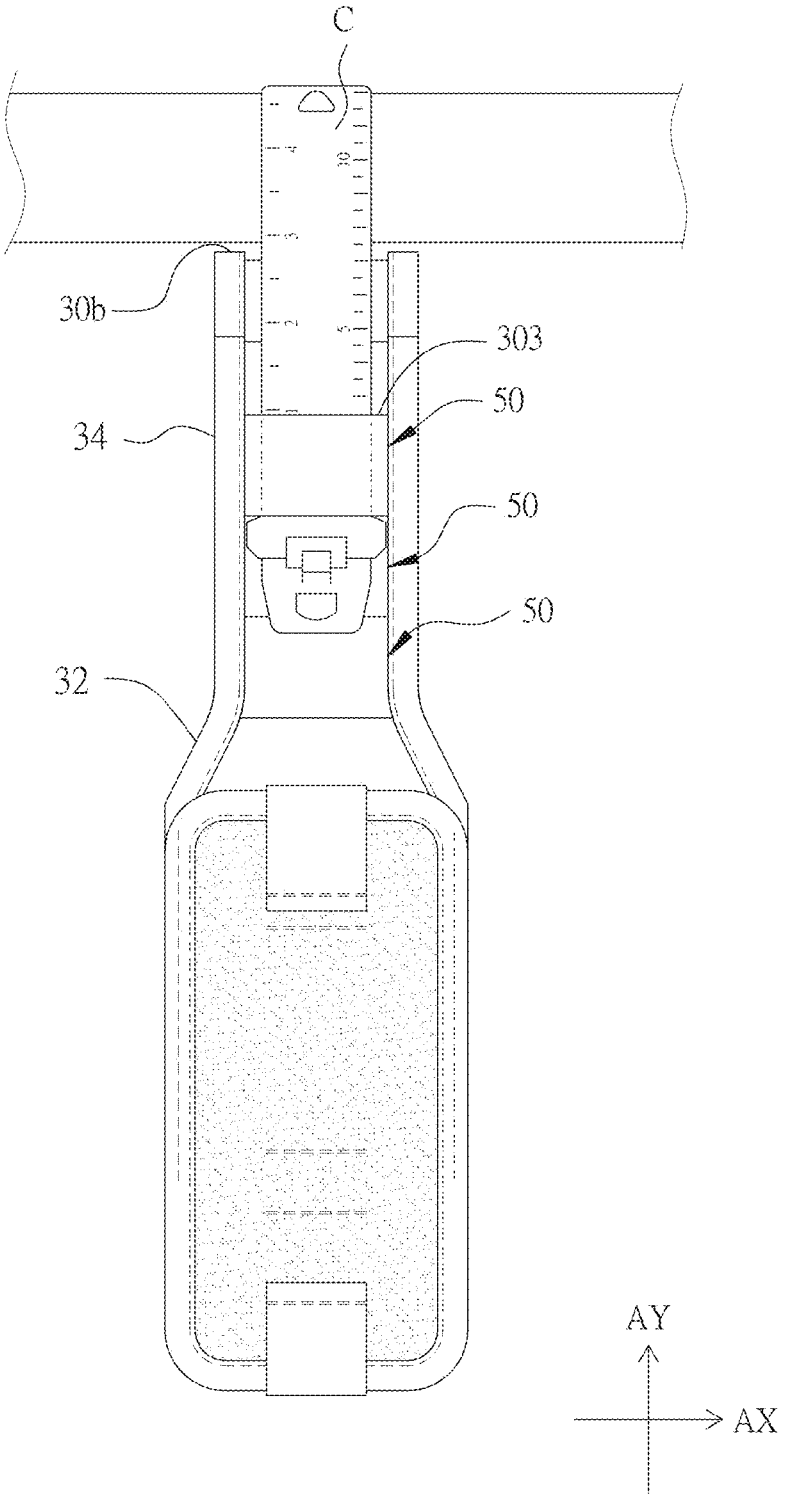
FIG. 3 is similar to FIG. 2, showing that the connecting member passes through the second through hole of one of the second straps that is topmost among the second straps in the vertical direction according to the embodiment of the present invention.

As shown in FIG. 1*a* and FIG. 2, the strap body 30 has a connecting end 30*a* and a free end 30*b*, wherein the connecting end 30*a* is connected to the first surface 101 of the first sheet body 12 of the sheet body 10 and is located at the upper opening 104. The strap body 30 has a third surface 301 and a fourth surface 302 opposite to the third surface 301. The third surface 301 is formed by extending from the first surface 101. As shown in FIG. 2, two ends of each of the second straps 50 are respectively connected to and fixed on the fourth surface 302. Each of the second straps 50 and the fourth surface 302 jointly form a second through hole 30. The second straps 50 and the second through holes 303 are arranged along the vertical direction AY, and the second straps 50 are arranged in a way parallel to one another. In this way, referring to FIG. 3, the connecting member C could pass through the second through hole 303 of the topmost one, the middle one, or the bottom one among the second straps 50 in the vertical direction AY, thereby adjusting the center of gravity while wearing the object carrier 1.

The second straps 50 are located upper than the first straps 20 in the vertical direction AY. In other words, the center of gravity could be adjusted by making the connecting member C pass through the second through hole 303 of the second straps 50 or the first through holes 103 of the first straps 20. Additionally, in the current embodiment, the number of the second strap 50 is three for illustration. In practice, the number of the second strap 50 could be two or more, which could achieve the aforementioned effect as well.

Figure 1B:
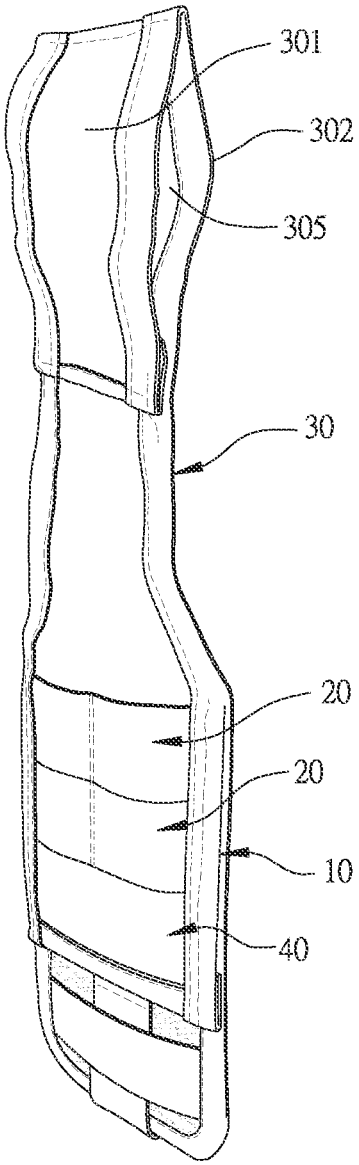
FIG. 1*b* is a schematic view of the object carrier according to another embodiment of the present invention.

In the current embodiment, the strap body 30 is a sheet shape as an example. Referring to FIG. 1*b*, in another embodiment, the strap body 30 could provide an annular space 305 between the third surface 301 and the fourth surface 302 for being passed through by the connecting member C, such as the waistband, the strap, or the fastener. In this way, when a user wears the connecting member C, the object connected to the connecting portion 10*a* could hang down below the strap body 30, thereby adjusting the center of gravity to a lower position.

Figure 4:
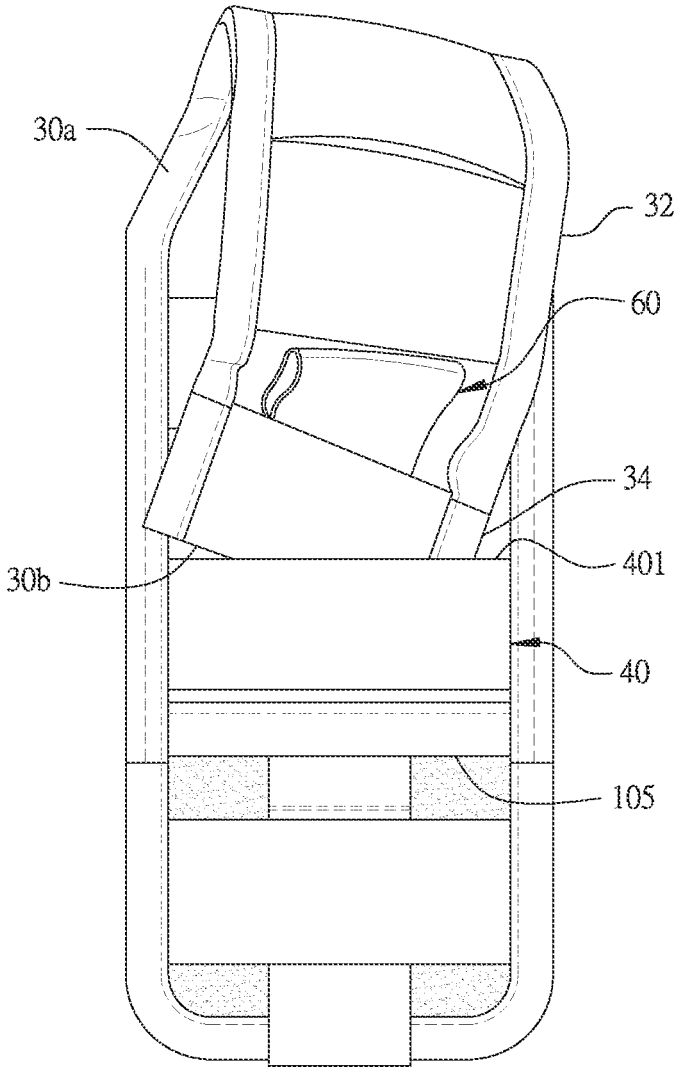
FIG. 4 is a schematic view, showing that the free end of the strap body passes through the positioning through hole according to the embodiment of the present invention.

As shown in FIG. 4, the strap body 30 has a first section 32 and a second section 34 that are connected to each other. The object carrier 1 includes a pull ring 60 disposed on the fourth surface 302 and located between the first section 32 and the second section 34. The first section 32 has the connecting end 30*a*, and the second section 34 has the free end 30*b*. In practice, the pull ring 60 of the object carrier 1 could be omitted.

Figure 9:
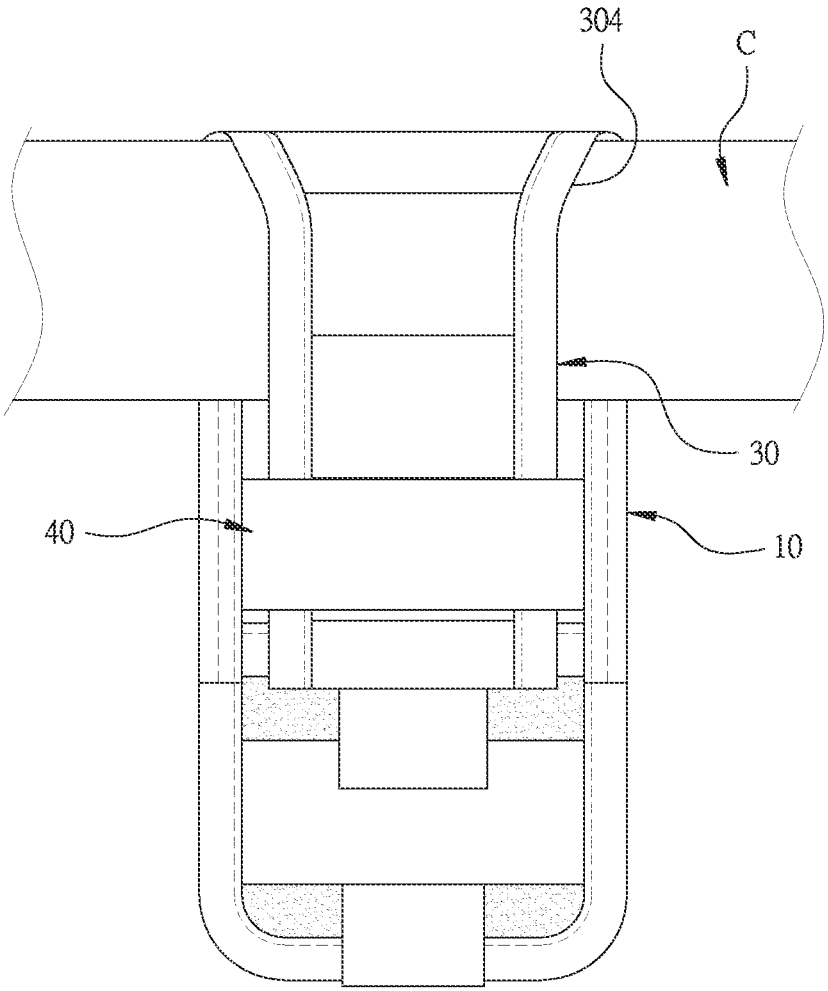
FIG. 9 is a schematic view, showing that the connecting member passes through the annular hole according to the embodiment of the present invention.
Figure 10:
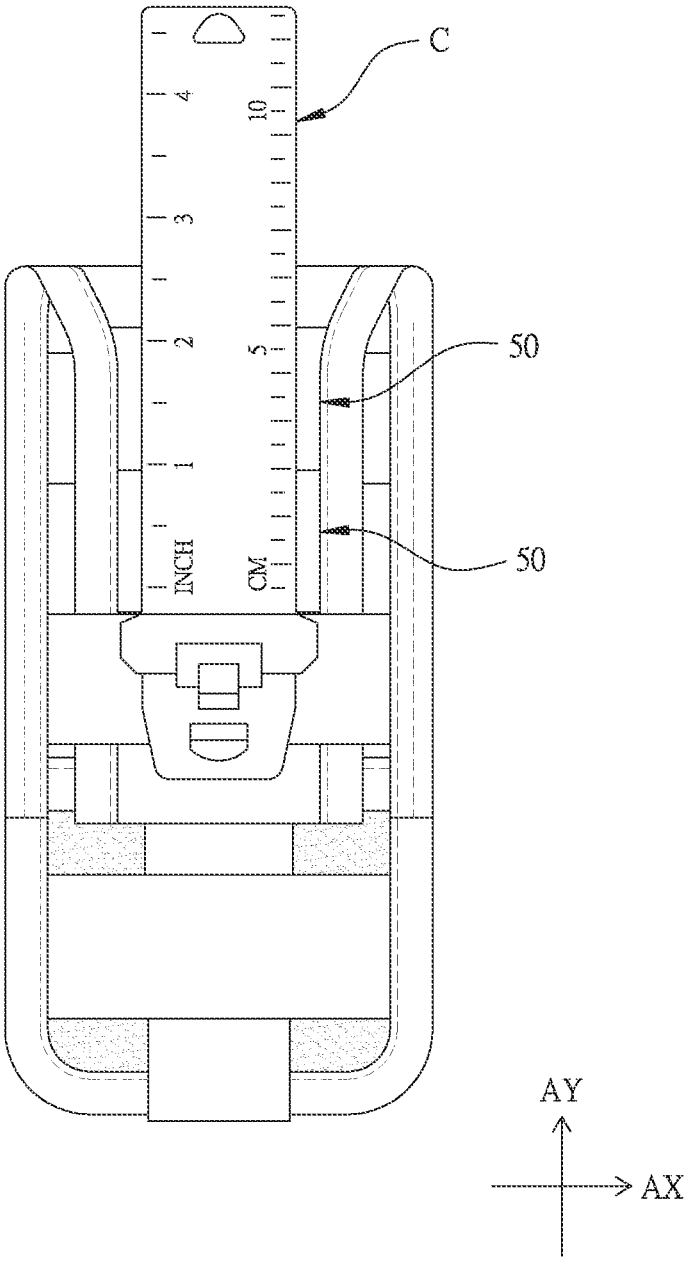
FIG. 10 is a schematic view, showing that the connecting member passes through the second through hole of one of the second straps that is topmost in the vertical direction according to the embodiment of the present invention.

As shown in FIG. 4 to FIG. 8, the strap body 30 could bend relative to the sheet body 10 at the connecting end 30*a*. A width of the strap body 30 is smaller than a diameter of the upper opening 104 and a diameter of the lower opening 105, and the free end 30*b* could enter the receiving space through the lower opening 105, making the strap body 30 and the sheet body 10 jointly surround to form an annular hole 304. In this way, referring to FIG. 9, the annular hole 304 could be provided for the connecting member C, such as the waistband, the strap, or the fastener, to pass through. Additionally, referring to FIG. 10, the connecting member C could pass through the second through hole 303 of the topmost one, the middle one, or the bottom one of the second straps 50 in the vertical direction AY, thereby making the center of gravity adjustable.

Referring to FIG. 1*a*, in the current embodiment, the object carrier 1 includes a positioning plate 70 disposed on the free end 30*b*. The strap body 30 is made of a flexible material, and the positioning plate 70 is made of a material harder than the strap body 30. In this way, referring to FIG. 5, when the free end 30*b* enters the receiving space through the lower opening 105, the positioning plate 70 could tightly fit in the lower opening 105 to be firmly stuck at the lower opening 105.

Figure 5:
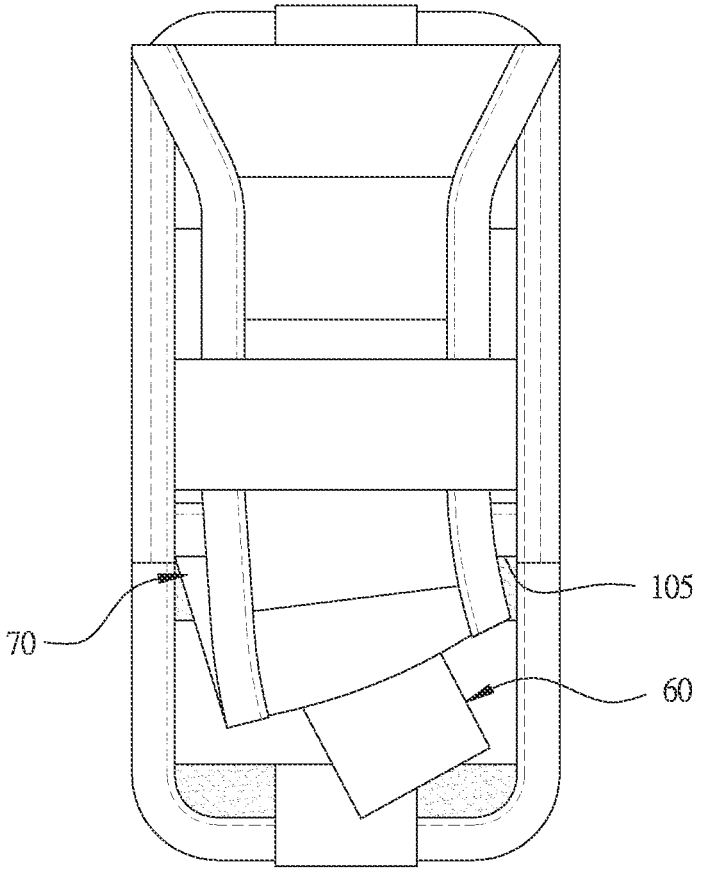
FIG. 5 is a schematic view showing that the free end of the strap body passes through the lower opening according to the embodiment of the present invention.
Figure 6:
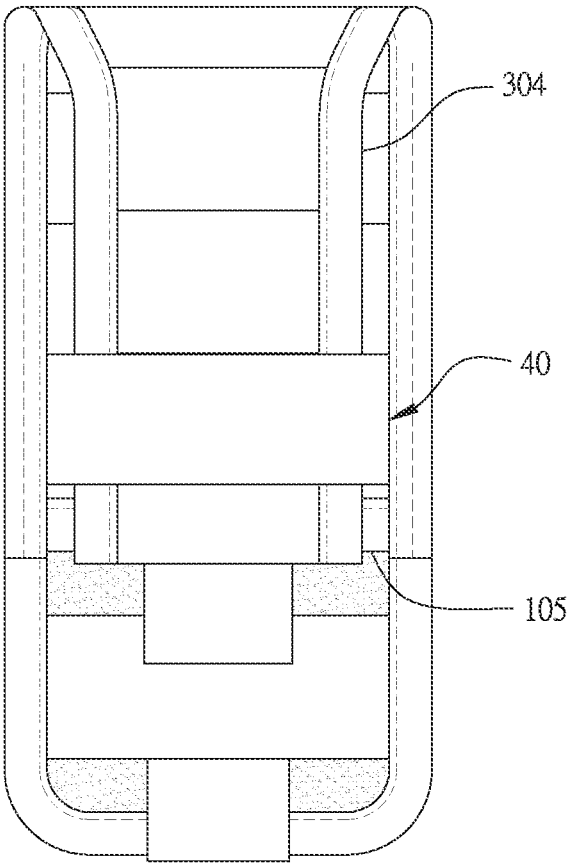
FIG. 6 is similar to FIG. 5, showing that the free end of the strap body enters the lower opening according to the embodiment of the present invention.
Figure 7:
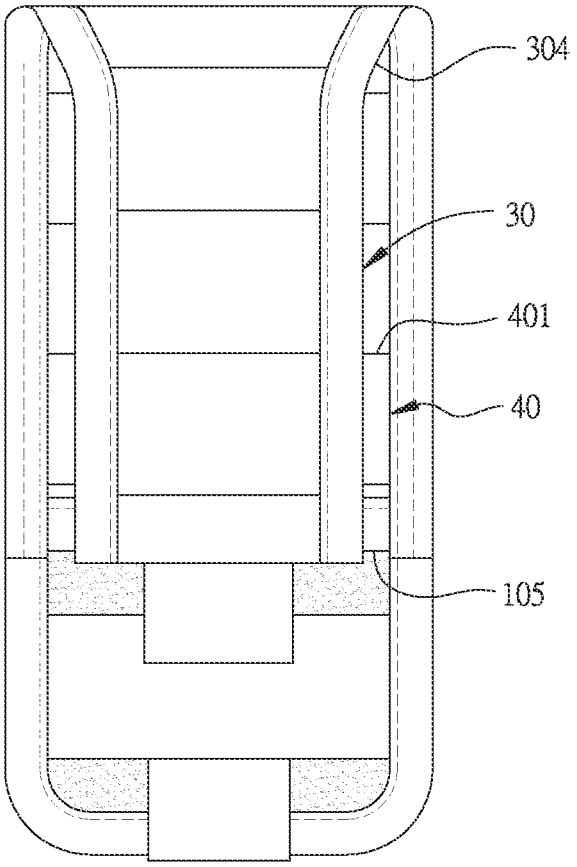
FIG. 7 is a schematic view, showing that the free end of the strap body enters the lower opening according to the another embodiment of the present invention.

Referring to FIG. 1 and FIG. 4, in the current embodiment, the positioning strap 40 of the object carrier 1 is located at a position closer to the lower opening 105 than the first straps 20. The positioning strap 40 and the first surface 101 jointly form a positioning through hole 401. The free end 30*b* of the strap body 30 could pass through the positioning through hole 401 (as shown in FIG. 4) and then enter the receiving space through the lower opening 105 (as shown in FIG. 5). Referring to FIG. 7, in the another embodiment, the free end 30*b* of the strap body 30 could enter the receiving space through the lower opening 105 without passing through of the positioning through hole 401, thereby a user could choose whether to pass the free end 30*b* of the strap body 30 through the positioning through hole 401 depending on the required demand. For example, when the free end 30*b* of the strap body 30 passes through of the positioning through hole 401, the problem that the strap body 30 being pulled to make the free end 30*b* detach from the receiving space could be prevented, thereby the free end 30*b* of the strap body 30 could be firmly disposed in the receiving space; when the free end 30*b* of the strap body 30 enters the receiving space directly through the lower opening 105 without passing through the positioning through hole 401, it is conducive to detach the free end 30*b* from the receiving space or place the free end 30*b* in the receiving space, enhancing the convenience in use. In practice, the positioning strap 40 of the object carrier 1 could be omitted.

Figure 11:
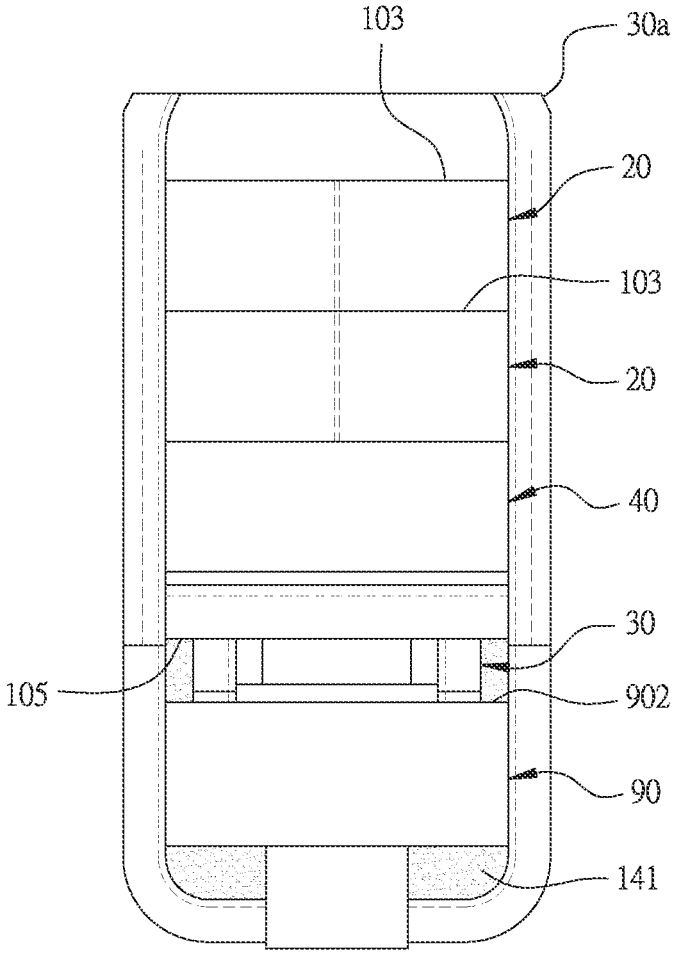
FIG. 11 is a schematic view, showing that the strap body bends relative to the sheet body to enter the receiving space from the upper opening and pass through the lower opening according to the embodiment of the present invention.
Figure 12:
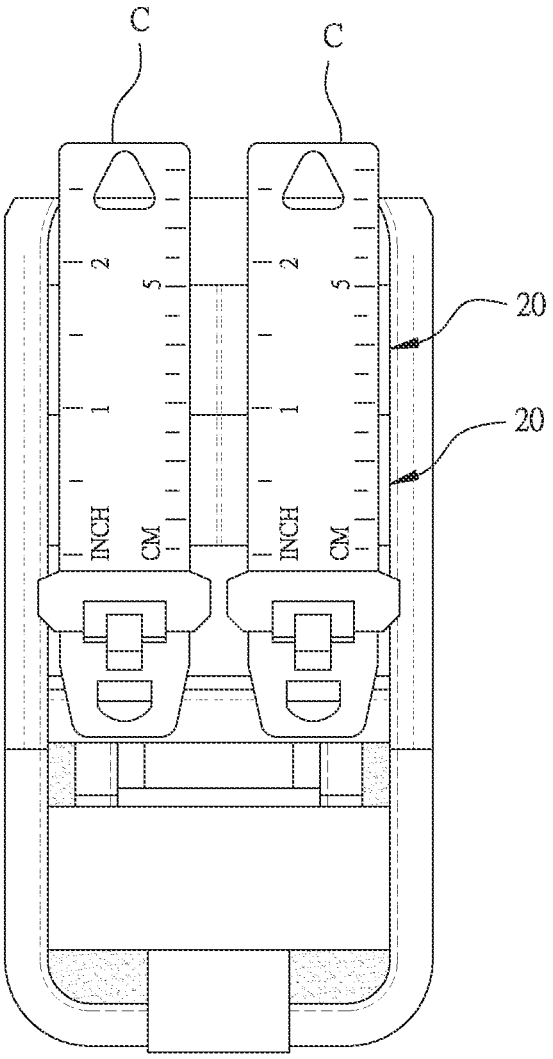
FIG. 12 is a schematic view, showing that each of the connecting members passes through one of the first through holes according to the embodiment of the present invention.

As shown in FIG. 11, the strap body 30 could bend relative to the sheet body 10 at the connecting end 30*a*, and the free end 30*b* could enter the receiving space through the upper opening 104. In this way, the first straps 20 disposed on the sheet body 10 could be exposed outwards, and each of the first through holes 103 could be passed through by one connecting member C. As shown in FIG. 12, each of the connecting members C is a fastener as an example, wherein one end of the fastener could pass through one of the first through holes 103 to fasten with another end of the fastener. In this way, each of the fasteners and the sheet body 10 could jointly form an annular space for another object to pass through.

Referring to FIG. 11, in the current embodiment, the object carrier 1 includes a third strap 90. The second sheet body 14 has a fifth surface 141 opposite to the second surface 102, wherein the fifth surface 141 is formed by extending outwards from the lower opening 105. Two ends of the third strap 90 are respectively connected to the fifth surface 141 to jointly form a third through hole 902 with the fifth surface 141. Therefore, the free end 30*b* of the strap body 30 could enter the third through hole 902 after passing through the receiving space through the upper opening 104 and the lower opening 105. In practice, the third strap 90 of the object carrier 1 could be omitted.

Figure 13:
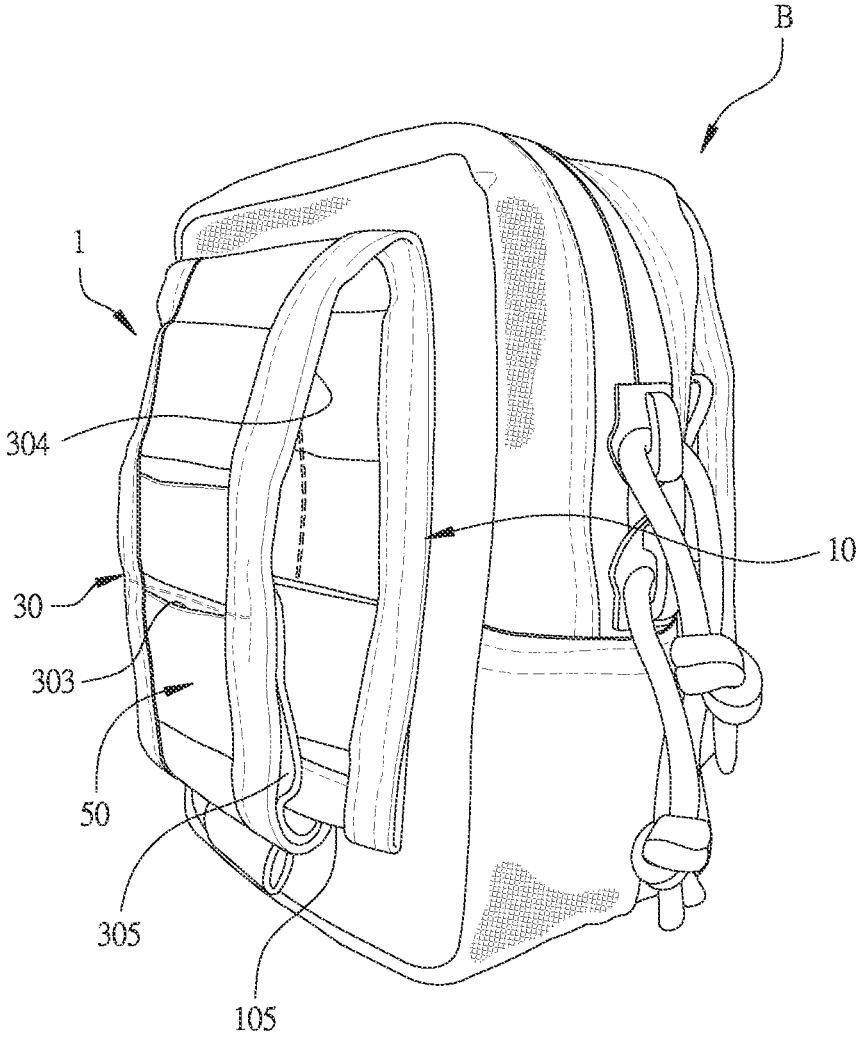
FIG. 13 is a perspective view of the object carrier according to the another embodiment of the present invention, showing the object carrier is connected to the bag.
Figure 14:
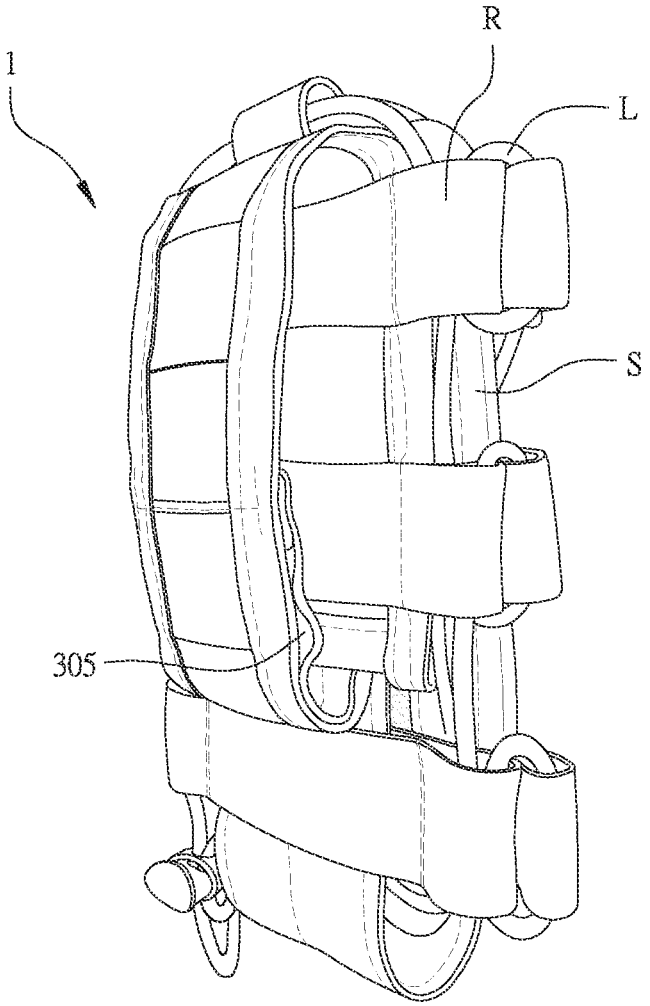
FIG. 14 is similar to FIG. 13, showing the object carrier according to the another embodiment of the present invention is connected to the flat object.

FIG. 13 and FIG. 14 respectively illustrate that the object carrier 1 is connected to the object through the connecting portion 10*a* as an example. Referring to FIG. 13, in the another embodiment, the connecting portion 10*a* of the object carrier 1 could be connected to a bag B. Or as shown in FIG. 14, the connecting portion 10*a* of the object carrier 1 could be connected to a flat object S via a sleeve ring R and a cord L.

With the aforementioned design, the first through holes or the second through holes of the object carrier of the present invention could be passed through by the connecting member, such as the waistband, the strap, or the fastener, and the object carrier could be attached to the user or an accessory, such as a bag, via the connecting member. As the first through holes and the second through holes are disposed on different positions, the user could select from the first through holes or the second through holes to adjust the center of gravity. Additionally, when the strap body bends relative to the sheet body at the connecting end, and the free end enters the receiving space through the lower opening to be received in the receiving space, the strap body and the sheet body could jointly surround to form the annular hole for being passed through by the connecting member, such as the waistband, the strap, or the fastener. Moreover, the connecting member, such as the waistband, the strap, or the fastener, could pass through the receiving space through the top opening and the lower opening, providing multiple wearing ways for the user to select, thereby enhancing the comfortability and convenience.

It must be pointed out that the embodiments described above are only some preferred embodiments of the present invention. All equivalent structures which employ the concepts disclosed in this specification and the appended claims should fall within the scope of the present invention.

What is claimed is:

1. An object carrier comprising:

a sheet body having a receiving space therein and having an upper opening and a lower opening respectively located on two opposite sides of the receiving space for communicating the receiving space with an external space, wherein the sheet body has a first surface and a second surface opposite the first surface; the second surface has a connecting portion adapted to be connected to an object;

at least two first straps, wherein each of the at least two first straps and the first surface are connected to jointly form at least one first through hole;

a strap body having a connecting end and a free end, wherein the connecting end is connected to the first surface of the sheet body and is located at the upper opening; the strap body has a third surface and a fourth surface opposite to the third surface; the third surface is formed by extending from the first surface;

at least two second straps, wherein each of the at least two second straps and the fourth surface are connected to jointly form a second through hole; and a positioning strap disposed at a position closer to the lower opening than the at least two first straps; the positioning strap and the first surface jointly form a positioning through hole; the free end of the strap body is adapted to pass through the positioning through hole and then enter the receiving space through the lower opening; and wherein, the strap body bends relative to the sheet body at the connecting end, and the free end is adapted to enter the receiving space through the upper opening or the lower opening.

2. The object carrier as claimed in claim 1, wherein the at least two first straps are arranged adjacently in a vertical direction, and each of the at least two first straps and the first surface jointly form two first through holes arranged adjacently in a horizontal direction.

3. The object carrier as claimed in claim 2, wherein the at least two first straps are parallel to each other.

4. The object carrier as claimed in claim 1, wherein the at least two second straps and the second through holes are arranged along a vertical direction, and the at least two second straps are disposed adjacently.

5. The object carrier as claimed in claim 4, wherein the at least two second straps are parallel to each other.

6. The object carrier as claimed in claim 1, further comprising a positioning plate disposed at the free end.

7. The object carrier as claimed in claim 1, wherein the strap body has a first section and a second section that is connected to the first section; the object carrier further comprises a pull ring disposed on the fourth surface and located between the first section and the second section; the first section has the connecting end, and the second section has the free end.

8. The object carrier as claimed in claim 1, wherein a width of the strap body is smaller than a diameter of the upper opening and a diameter of the lower opening.

9. The object carrier as claimed in claim 1, wherein the strap body has an annular space located between the third surface and the fourth surface.

10. An object carrier comprising:

a sheet body having a receiving space therein and having an upper opening and a lower opening respectively located on two opposite sides of the receiving space for communicating the receiving space with an external space, wherein the sheet body has a first surface and a second surface opposite the first surface; the second surface has a connecting portion adapted to be connected to an object;

at least two first straps, wherein each of the at least two first straps and the first surface are connected to jointly form at least one first through hole;

a strap body having a connecting end and a free end, wherein the connecting end is connected to the first surface of the sheet body and is located at the upper opening; the strap body has a third surface and a fourth surface opposite to the third surface; the third surface is formed by extending from the first surface;

at least two second straps, wherein each of the at least two second straps and the fourth surface are connected to jointly form a second through hole; and a third strap, wherein the sheet body comprises a first sheet body and a second sheet body that are stacked on each other; the first sheet body has the first surface, and the second sheet body has the second surface; the receiving space is located between the first sheet body and the second sheet body; the second sheet body has a fifth surface opposite to the second surface and formed by extending from the lower opening; two ends of the third strap are respectively connected to the fifth surface to jointly form a third through hole with the fifth surface; and wherein, the strap body bends relative to the sheet body at the connecting end, and the free end is adapted to enter the receiving space through the upper opening or the lower opening.

11. The object carrier as claimed in claim 10, wherein the at least two first straps are arranged adjacently in a vertical direction, and each of the at least two first straps and the first surface jointly form two first through holes arranged adjacently in a horizontal direction.

12. The object carrier as claimed in claim 11, wherein the at least two first straps are parallel to each other.

13. The object carrier as claimed in claim 10, wherein the at least two second straps and the second through holes are arranged along a vertical direction, and the at least two second straps are disposed adjacently.

14. The object carrier as claimed in claim 13, wherein the at least two second straps are parallel to each other.

15. The object carrier as claimed in claim 10, further comprising a positioning plate disposed at the free end.

16. The object carrier as claimed in claim 10, wherein the strap body has a first section and a second section that is connected to the first section; the object carrier further comprises a pull ring disposed on the fourth surface and located between the first section and the second section; the first section has the connecting end, and the second section has the free end.

17. The object carrier as claimed in claim 10, wherein a width of the strap body is smaller than a diameter of the upper opening and a diameter of the lower opening.

18. The object carrier as claimed in claim 10, wherein the strap body has an annular space located between the third surface and the fourth surface.

* * * * *